United States Patent [19]

Balkin

[11] Patent Number: 4,964,550

[45] Date of Patent: Oct. 23, 1990

[54] LOCKING GARMENT HANGER

[76] Inventor: Larry M. Balkin, 2690 Valleydale Dr., Conyers, Ga.

[21] Appl. No.: 326,323

[22] Filed: Mar. 21, 1989

Related U.S. Application Data

[62] Division of Ser. No. 170,763, Mar. 21, 1988, Pat. No. 4,852,777.

[51] Int. Cl.[5] ..... A47G 25/52

[52] U.S. Cl. ..... 223/91

[58] Field of Search ..... D6/317, 319, 326; 211/119; 223/88, 90, 91, 96

[56] References Cited

U.S. PATENT DOCUMENTS

| | | | |
|---|---|---|---|
| 554,609 | 2/1896 | Walter | 223/91 |
| 1,018,057 | 2/1912 | Hincher | 223/91 |
| 1,399,707 | 12/1921 | Emerson | 223/91 |
| 1,605,918 | 11/1926 | Buchanan | 223/91 |
| 1,818,193 | 8/1931 | Burde | 223/88 |
| 2,042,240 | 5/1936 | Shaffer | 223/91 |
| 2,193,718 | 3/1940 | Floch | D6/317 X |
| 2,318,770 | 5/1943 | Freeman | 223/91 |
| 2,553,282 | 5/1951 | Sokolik | 223/91 |
| 2,903,169 | 9/1959 | Kearney | 223/88 |
| 2,904,234 | 9/1959 | Pinkham | 223/91 |

FOREIGN PATENT DOCUMENTS

| | | | |
|---|---|---|---|
| 1280093 | 11/1961 | France | 223/91 |

*Primary Examiner*—Werner H. Schroeder
*Assistant Examiner*—David K. Suto
*Attorney, Agent, or Firm*—Thomas & Kerr

[57] ABSTRACT

A locking garment is disclosed in which a single length of wire or similar resilient material is formed into a generally triangular frame member having a hook portion for suspending the hanger from a suitable support. Arm members depend angularly downward from the hook portion and are joined by a transverse garment supporting rod member. Integrally formed in the wire are clip means in generally horizontal planar alignment with the rod member and spring means for biasing the clip means against a garment disposed on the rod member upon lateral displacement of the clip means from a resting position of a garment securing position.

12 Claims, 3 Drawing Sheets

LOCKING GARMENT HANGER

This is a divisional of co-pending application Ser. No. 170,763, filed on Mar. 21, 1988, now U.S. Pat. No. 4,852,777.

BACKGROUND OF THE INVENTION

Garment hangers are widely used by individuals, dry cleaners, uniform rental services, clothing manufacturers, clothing stores and other establishments for storing, hanging, and transporting garments. The majority of such hangers are formed from a relatively thin gauge steel wire. Reasons for the wide use of wire hangers include, among others, the ease of manufacture, plentiful supply of the necessary materials used in manufacturing the hangers, durability, and their relatively low cost in comparison with competing devices and materials used in manufacture, such as wood or plastic.

There are two basic types of wire hangers currently widely in use. The first type has an upper hook member for engaging the supporting rod and suspending the hanger. Extending angularly from the hook member on each side thereof are arm members which engage the shoulder and arm portions of the shirt or coat hung thereon. A bottom or lower rod member is extended transversely, integrally connecting the lower ends of the arm members for receiving and holding trousers, skirts, etc., thus providing a generally triangular configuration.

The second basic type includes the hook and angular arm members; however, the arm members are terminated at their lower ends and configured to receive and support a transverse cross member, normally a cardboard or paper tube, for receiving and holding trousers etc. A particular problem with such hangers is the general lack of any means to secure garments on the lower transverse rod or tube member, thus, the garments may easily slip off of the rod member during transporting of the garments or simply by gravity. Prior art devices which attempt to prevent this problem have, in general, provided upwardly projecting means or fingers which engage the cuffs or belt loops of the garment, as illustrated by U.S. Pat. No. 2,812,888 to Hendersonn for a Garment Hanger, and U.S. Pat. No. 2,171,693 to Glendenning, for a Trouser Hanger. A different type of construction with the same purpose is shown in U.S. Pat. No. 2,426,330 to Yacoe for a Skirt and Trouser Hanger. All of these devices provide means to hold and secure trousers or skirts; however, the shirt or coat engaging arm members are eliminated, thus decreasing the versatility and usefulness of the hanger while adding to overall production, material, and utilization costs in that separate hangers are required for shirts, coats, and the like.

Thus, a need continues to exist in the art for a garment hanger which provides positive securement of garments on the lower rod member without sacrificing functions provided by the more basic types of hangers described hereinabove.

SUMMARY OF THE INVENTION

It is, therefore, one of the principal objects of the present invention to provide a locking garment hanger which is easily constructed from a single length of a suitable resilient metal or plastic material, and which provides both a transverse lower support member for trousers and the like and upper arm members for shirts coats, etc.

Another object of the present invention is to provide a garment hanger which provides a positive locking means for garments disposed on the transverse, lower, garment support member, which locking means is easily and quickly engaged or disengaged to secure or release the garment, respectively.

A further object of the present invention is to provide a versatile garment hanger which avoids the disadvantages of prior art devices, which is durable to provide a long service life, and which is inexpensive to produce.

These and additional objects and advantages are attained by the present invention which relates to a locking garment hanger formed from a single length of wire or other suitable material into a generally triangular frame with a hook means at the apex of the frame for suspending the hanger from a suitable support rod. The hanger further includes arm members for supporting a garment such as a shirt, depending angularly in opposed directions from the hook means. The arm members are joined by a lower garment supporting rod member. Clip means for securing the garment on this lower rod member are integrally formed along with spring means into the hanger frame and are designed to provide a high frictional force between the lower rod member, the clip means and the garment.

DETAILED DESCRIPTION OF THE PREFERRED EMBODIMENT

Figure 1:
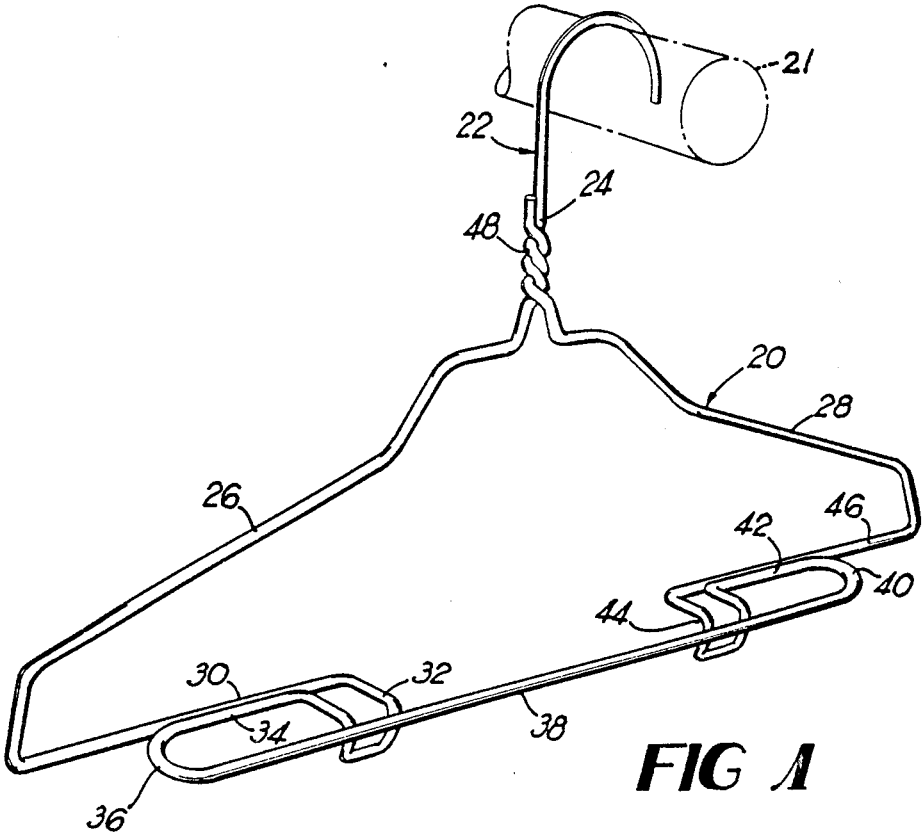
FIG. 1 is a perspective view of one embodiment of the present locking garment hanger.

Referring now more specifically to the drawings and to FIG. 1 in particular, numeral 20 designates generally the locking garment hanger of the present invention. As shown, the hanger is constructed from a single length of wire, a typical size being 13 or 14 gauge wire. The wire is characterized by a high degree of tensile strength and a desired feature of elastic memory. While the following description will focus on a garment hanger constructed of wire, it will be understood by those skilled in the art that certain plastics or other materials may also be suitable for the purposes of this invention and the use of wire as an example is not meant to limit the invention in any way.

One end of the wire is formed into a hook member 22 which serves to engage the rod 21 in closets, clothing racks etc. The wire extends from the neck portion 24 of the hook member to form a substantially triangular garment supporting frame member, thus bringing the opposite end of the wire back to the neck 24 of the hook member where it is twisted around the neck portion or similarly secured thereto, thereby forming an essentially permanently engaged structure. Extending angularly from the hook portion on both left and right sides thereof, as shown in the drawings are arm members 26 and 28 respectively, which serve to engage and support shirts, coats and the like.

The description now proceeds with the directional terms being relative to the support rod 21 and/or the floor (not shown), these being normally parallel to one another, thus providing a convenient frame of reference, the support rod being generally as shown in phantom lines in the various drawing figures.

Arm 26 extends angularly downward from the neck 24 of hook member 22 for a distance sufficient to extend along the shoulder portion of a shirt or coat, generally to the area of the garment where the arm portion of the garment is connected the shoulder portion. The direction of the wire is then directed inwardly relative to the shoulder rod forming a short extension 30 which is generally parallel with the floor.

The wire is then configured into a first, generally concave, U-shaped garment retaining clip means 32, disposed below the approximate midpoint of arm 26. From the clip 32, the direction of the wire is reversed to form another short extension 34 which extends outwardly from the clip, adjacent and parallel to extension 30. The direction of the wire is then again reversed one hundred eighty degrees (180°) at point 36 and extended inwardly from point 36 to form the garment receiving rod member 38. Thus, as shown in FIG. 1, rod member 38 forms the bottom or lower transverse portion of the generally triangular framed hanger, extending generally parallel to extensions 30 and 34.

The configuration of the wire is duplicated on the right side of the present hanger, as viewed in FIG. 1. The direction of the transverse rod member 38 is reversed one hundred eighty degrees (180°) at point 40 to extend inwardly, thereby forming a short extension 42, which runs generally parallel to rod 38. The wire is then configured into a second, generally concave, U-shaped garment retaining clip means 44, disposed below the approximate midpoint of arm 28. From clip 44, the direction of the wire is reversed again relative to extension 42, forming a short extension 46, disposed adjacent and parallel to extension 42. The wire is then directed upwardly to form arm 28, which extends angularly toward the neck portion 24 of hook member 22. Securement of the wire is normally effected by twisting the end of the wire around the neck portion, as indicated by numeral 48, or by other suitable means.

Figure 2:
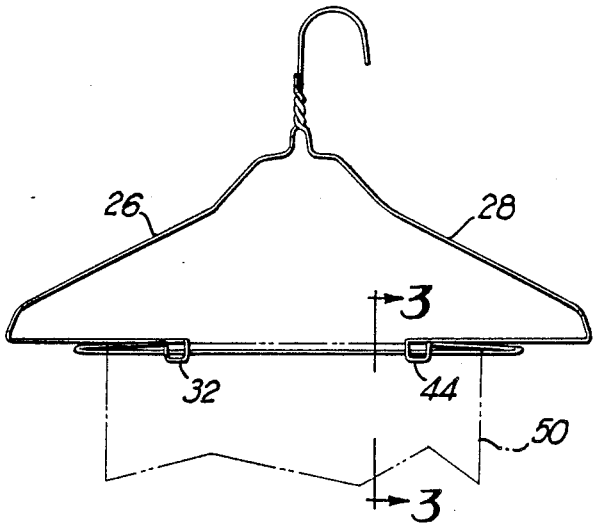
FIG. 2 is a side elevational view of the embodiment shown in the preceding figure, a pair of trousers being shown in phantom lines on the hanger.
Figure 3:
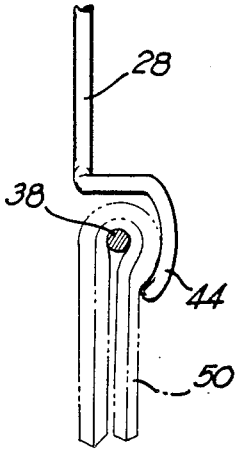
FIG. 3 is a partial cross-sectional view, the section being taken on line 3—3 of FIG. 2.

The configuration of the hanger thus described and shown in FIGS. 1–3 provides several advantages heretofore unknown in the art. The garment receiving rod member 38 and the clip means 32 and 44 are disposed in spaced, vertical planes, thus providing an effectively widened base compared to conventional hangers of this general type, with the base remaining in substantially horizontal planar alignment. The curved or bent portions of the wire at points 36 and 40 also serve as integral spring means which, in an undisturbed or resting state, as shown in FIG. 1, space rod member 38 from the clip means.

The spacing just described provides an entry or passageway for garments, such as trousers 50, shown in phantom lines in FIGS. 2 and 3. The garment is passed between rod member 38 and clip means 32 and 44 and draped over the rod member 38 on the side of the rod member opposite the side closest to the clip means when the clip means are in the resting position shown in FIG. 1. Securement of the garment is effected by the application of upward and lateral pressure to the clip means, raising them sufficiently to pass over the garment and rod member 38, and displacing the clip means laterally a sufficient distance to dispose the clip means on the side of the rod member 38 opposite the side on which they are disposed when in a resting state and against the garment, such displacement and consequent securement of the garment being shown in FIGS. 2 and 3.

The displacement of the clip means 32 and 44 from their resting position of FIG. 1 to the garment securing position shown in FIGS. 2 and 3 creates a high degree of friction between the rod member 38, the garment 50, and the clip means. The force creating this friction is provided by the integral spring means formed by the curvature of portions 36 and 40, the elasticity being related to the tensile strength of the wire or other material, thus biasing the clip means against the garment for positively locking the garment on rod member 38. As the locking force of the clip means is in part determined by the tensile strength of the material used in constructing the present hanger, it is desirable to utilize a high strength material, for example, with steel wire, a relatively high carbon content in the steel provides a high degree of tensile strength.

Releasing the grip of the clip means on the garment is easily accomplished by applying upward pressure against the secured clip means. With the clips disengaged from the garment, the potential energy stored in the spring means 36 and 40 by crossing the clips over rod member 38 is released. The spring means thus cause the clips to return to their resting state, as shown in FIG. 1, restoring the spacing between the rod member 38 and the clips 32 and 44, and enabling the removal of the garment 50.

The use and operation of the present device is quickly and easily accomplished, as explained by way of example, to a procedure typical in dry cleaning shops or uniform cleaning and rental operations. As trousers, for example, are pressed in a commercial pressing iron, the present hanger, held with one hand near the neck portion 24, is positioned near the lower leg portions or cuff end of the trousers. The worker lifts the leg portions and slides the rod member 38 along the lower surface of the iron, the trousers being received in the space between rod member 38 and the clip means 32 and 44. The hanger and garment are then lifted and the clip means are displaced over and across the garment and rod member 38, thereby tensing the spring means 36 and 40 and securing the garment on the hanger.

The advantages of such securement is especially obvious with regard to a uniform rental service where the cleaned uniforms are loaded into a vehicle and delivered to the customers. The motion of the vehicle, which, in combination with the weight of the trousers or the like, would normally cause at least some of the garments to fall from a conventional hanger, has no effect on garments secured by the present invention.

The garments remain secured and thus pressed until the clip means 32 and 44 are disengaged, releasing the potential energy stored in the tensed spring means 36 and 40. The clip means can then return to their resting position, as shown in FIG. 2, restoring the spacing between rod member 38 and the clip means and enabling the removal of the garment.

Figure 4:
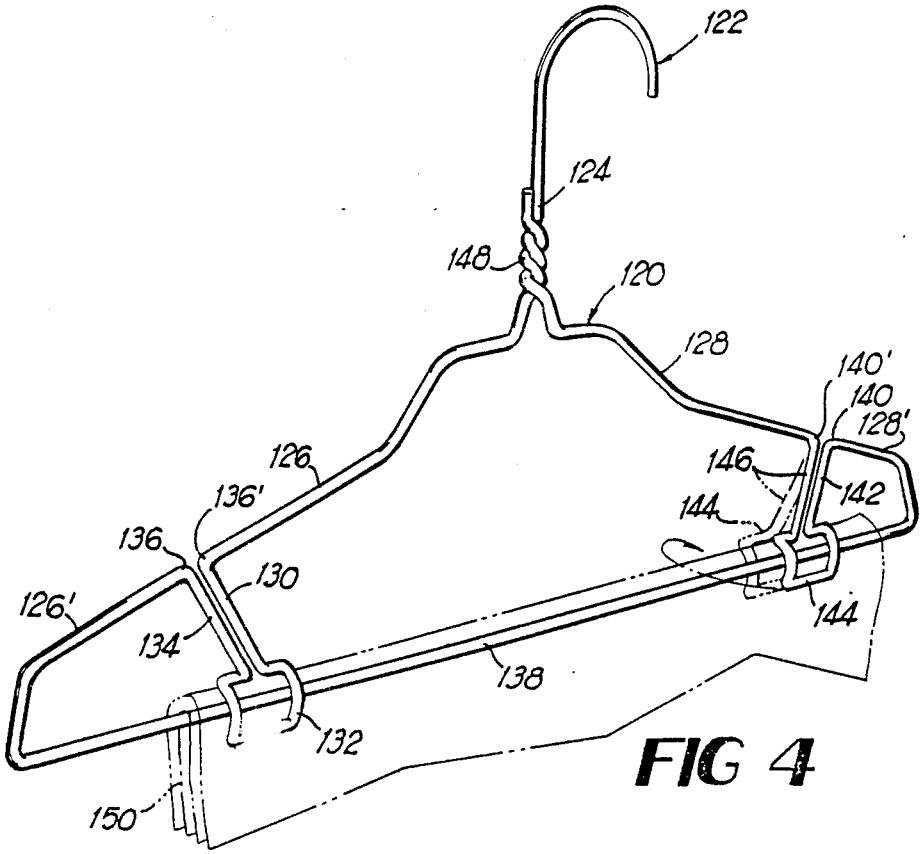
FIG. 4 is a perspective view of an alternate embodiment of the present locking garment hanger, a pair of trousers being engaged thereon and shown in phantom lines.
Figure 5:
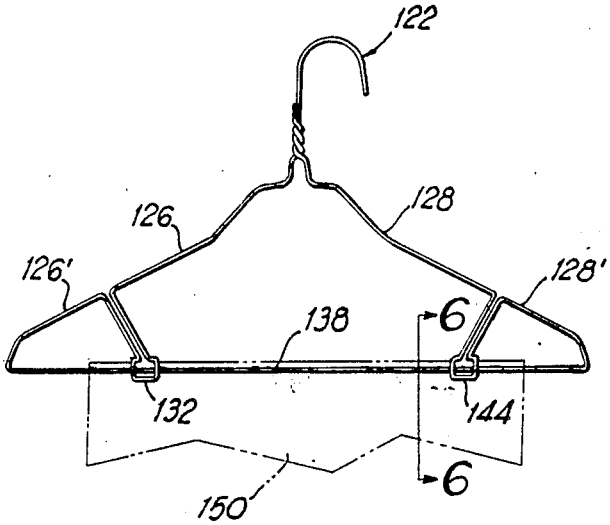
FIG. 5 is a side elevational view of the embodiment shown in the preceding figure.
Figure 6:
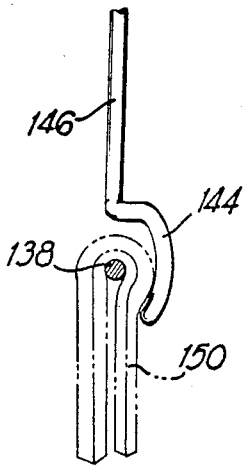
FIG. 6 is partial cross-sectional view showing the locking member, the view being taken on line 6—6 of FIG. 5.

FIGS. 4 through 6 and FIGS. 7 through 9 illustrate alternate embodiments of the present invention, wherein similar numerals are used to define similar elements. Referring to FIGS. 4 through 6, hanger 120 is formed into a generally triangular framed member from a relatively thin gauge steel wire or its equivalent, the material being characterized by a high tensile strength. The hanger includes a semicircular hook member 122, the wire extending downwardly therefrom to form neck portion 124. The wire is then extended generally angularly downward from the neck portion 124, forming a first portion of arm member 126, which also has a second portion 126'.

At the approximate midpoint of arm 126, the wire is curved or bent downwardly, forming a short rod extension member 130. The wire is then configured into a first, generally concave, U-shaped garment retaining clip means 132 as in the previous embodiment. From clip 132, the wire is then directed upwardly, forming a short rod extension member 134, disposed parallel to rod extension 130. The wire is then directed outwardly and extended angularly downward in generally axial alignment with rod member 126, forming rod portion 126', thereby completing the arm member of the hanger.

The wire is then directed inwardly, in a generally transverse direction relative to hook member 122, forming a garment receiving rod member 138, which comprises the base of the generally triangular hanger frame. The configuration of the wire is duplicated on the right side of the hanger 120, as viewed in FIG. 4, the wire being extended angularly upward from the opposite end of rod member 138, forming arm member 128'.

The wire is then directed downwardly at the approximate midpoint of the left arm member, toward rod member 138, forming a short rod extension 142. At the end of extension 142, the wire is configured into a second, generally concave, U-shaped garment retaining clip means 144, the resting position being illustrated in phantom lines and the garment securing position illustrated in unbroken lines. From clip means 144, the wire is directed upwardly to form a short rod extension 146, disposed parallel to extension 142. At the terminus of extension 146, the wire is curved or bent and extended angularly upwardly toward the hanger neck portion 124, forming arm member 128. Members 128 and 128 are formed in generally axial alignment, thereby completing the opposite arm member of the hanger, the end of the wire then being secured to the neck portion 124 as by twisted engagement therewith, as indicated by numeral 148.

As in the previous embodiment, the clip means 132 and 144 have a resting state, illustrated by the phantom-lined clip 144 in FIG. 4, wherein the clip means are spaced from rod member 138 for receiving a garment therebetween. With the garment 150, shown in phantom lines, disposed over rod member 138, the clip means are displaced upwardly and laterally with pressure applied to the clip means near their uppermost regions, to cross over rod member 138 and garment 150.

In this embodiment, the short extensions 130, 134, 142, and 146 are directed downwardly, as described, such that in their resting position, they lie in a vertical plane relative to the vertical plane of the rod member 138. Thus, when displaced into the garment-securing position, the curved portions of the wire, designated as 136 and 136' and 140 and 140', serve as spring means for biasing the clip means 132 and 144 against the garment and securing it on the rod 138.

Figure 7:
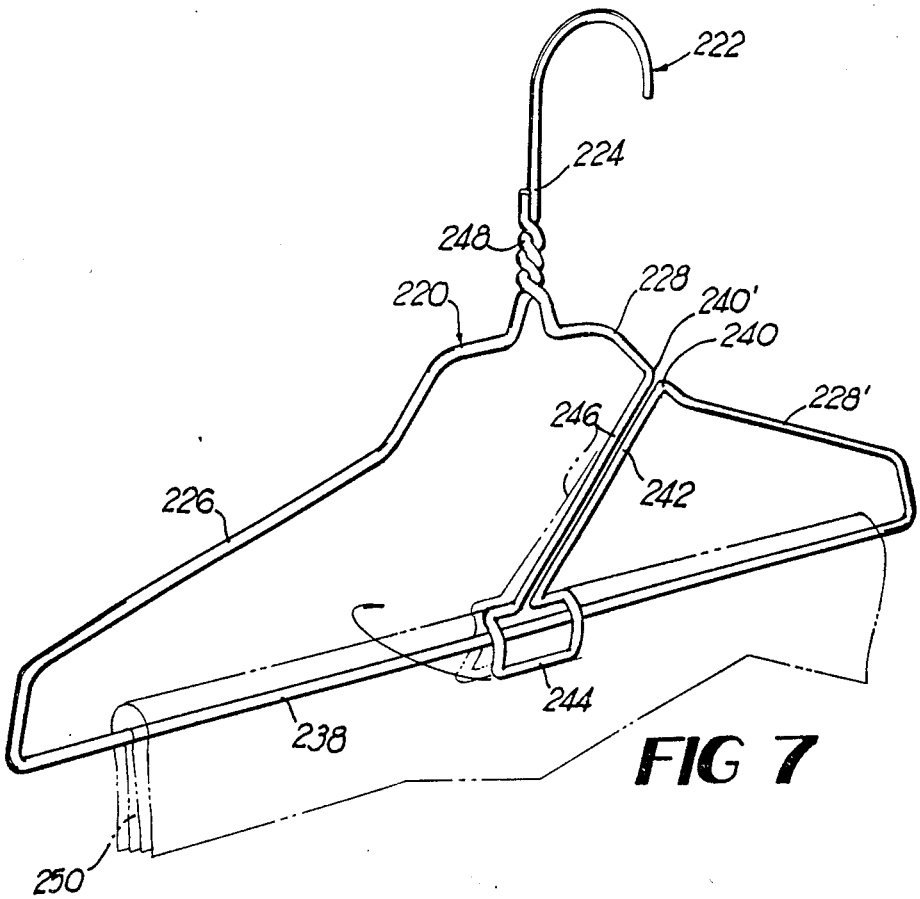
FIG. 7 is a perspective view of a third embodiment of the present invention, a pair of trousers being engaged on the hanger and shown in phantom lines.
Figure 8:
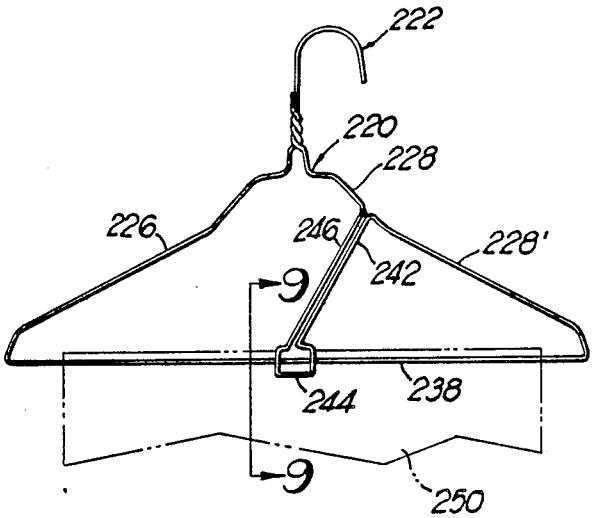
FIG. 8 is side elevational view of the embodiment shown in the preceding figure.
Figure 9:
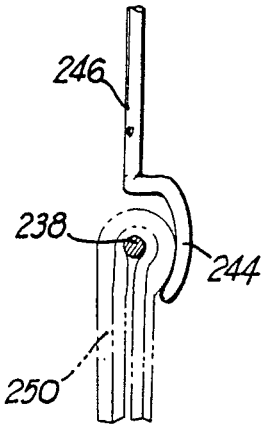
FIG. 9 is a partial cross-sectional view showing the locking member, the section being taken on line 9—9 of FIG. 8.

The embodiment shown in FIGS. 7 through 9 is essentially similar to the embodiment shown in FIGS. 4 through 6, except for the provision of only a single garment retaining member, as opposed to the dual retaining members described hereinabove. While illustrated on the right side of the hanger 220 in FIG. 7, it is to be understood that it may be provided on either side of the hanger.

Hanger 220 includes a hook member 222 with a depending neck portion 224. The wire is extended angularly downward therefrom, forming an arm member 226, and then transversely to form a garment receiving rod member 238. At the opposite end of member 238, the wire is directed angularly upward toward the neck portion 224, forming a portion of the opposite arm member 228'.

At a selected point, the wire is then curved or bent downwardly toward the rod member 238, forming a short rod extension 242. The wire is then configured into a garment retaining clip means 244, being generally concave and U-shaped. From clip means 244, the wire is directed upwardly, parallel to extension 242, forming a short rod extension 246. The wire is then again directed toward the neck portion 224 to form the remainder of the arm member 228. The end of the wire is then secured around the neck portion 224 as by twisted engagement, indicated by numeral 248.

As in the embodiment of FIGS. 4 through 6, the curved or bent portions of the wire at points 240 and 240', serve as integral spring means, the resting position of the garment retaining member being shown in broken lines in FIG. 7. With the garment 250 disposed over rod member 238, the clip means 244 may be displaced upwardly and laterally to cross over the garment and rod 238 to tense the spring means 240 and 240' and secure the garment on the hanger.

In the various embodiments herein described, it will be readily understood by those skilled in the art that the features of the present invention, for example, the generally concave clip means, could be configured differently from that shown in the drawings without detracting from their function. Thus, for example, the clip means could have a generally rectangular configuration with straight side walls, as opposed to the curved side walls illustrated, and still perform their garment retaining function. Such differences are considered within the scope of the present invention.

While an embodiment of a locking garment hanger and modifications thereof have been shown and described in detail herein, various additional changes and modifications may be made without departing from the scope of the present invention.

I claim:

1. A locking garment hanger comprising a length of wire formed into a generally triangular form having a hook means extending from an upper end of said triangular form for suspending said hanger from a suitable support, arm means extending angularly downward from both right and left sides of said hook means for supporting arm portions of a garment, and a lower garment supporting rod member formed as a continuation of said arm members, said rod member having first and second sides and having a first portion extending transversely relative to said arm means and disposed in a first vertical plane and a second portion formed into at least one garment retaining clip means having a generally vertical portion, said vertical portion being disposed in a plane parallel to said first plane when in a resting position and being spaced from said first side of said rod member, said clip means being laterally displaceable to said second side of said rod member for engaging and securing a garment disposed on said rod member.

2. A locking garment hanger as defined in claim 1 in which said hanger includes spring means integrally formed in said wire and disposed between said rod member and said clip means.

3. A locking garment hanger as defined in claim 1 in which said hanger includes a plurality of garment retaining clip means integrally formed in said wire.

4. A locking garment hanger as defined in claim 3 in which said clip means have a generally concave shape with an inwardly curved portion being disposed against the garment when said clip means is displaced to a garment securing position.

5. A locking garment hanger as defined in claim 4 in which said clip means are disposed below an appropriate midpoint of said arm means.

6. A locking garment hanger as defined in claim 1 in which said rod member and said clip means are disposed in substantially horizontal planar alignment.

7. A locking garment hanger comprising a length of wire formed into a generally triangular form having a hook means extending from an upper end of said triangular form for suspending said hanger from a suitable support, arm means extending angularly downward from both right and left sides of said hook means for supporting arm portions of a garment, and a lower garment supporting rod member formed as a continuation of said arm member, said rod member having first and second sides and having a first portion connected to and extending transversely relative to said arm means and disposed in a first vertical plane and a second portion formed into at least one garment retaining clip means having a generally vertical garment engaging portion, said generally vertical portion disposed in a plane parallel to said first plane when in a resting position and being spaced from said rod member, said clip means being laterally displaceable to the side of said rod member opposite the side on which said clip means is disposed when in said resting position for engaging and securing a garment disposed on said rod member.

8. A locking garment hanger as defined in claim 7 in which said hanger includes spring means integrally formed in said wire and disposed between said rod member and said clip means.

9. A locking garment hanger as defined in claim 7 in which said hanger includes a plurality of garment retaining clip means integrally formed in said wire.

10. A locking garment hanger as defined in claim 9 in which said clip means have a generally concave shape with an inwardly curved portion being disposed against the garment when said clip means is displaced to a garment securing position.

11. A locking garment hanger as defined in claim 10 in which said clip means are disposed below an appropriate midpoint of said arm means.

12. A locking garment hanger as defined in claim 7 in which said rod member and said clip means are disposed in substantially horizontal planar alignment.

* * * * *